US005465900A

United States Patent [19]

Baratto et al.

[11] Patent Number: 5,465,900

[45] Date of Patent: Nov. 14, 1995

[54] PRETAPED CONTAINER BLANKS

[75] Inventors: Eugene L. Baratto, Somerset, Wis.; John R. David, Stillwater, Minn.; Curtis L. Larson, Hudson, Wis.; Thomas L. Nelson, Woodbury; Norbert E. Wrobel, Marine on the St. Croix, both of Minn.

[73] Assignee: Minnesota Mining and Manufacturing Company, Saint Paul, Minn.

[21] Appl. No.: 372,850

[22] Filed: Jan. 13, 1995

Related U.S. Application Data

[63] Continuation of Ser. No. 132,805, Oct. 7, 1993, abandoned.

[51] Int. Cl.[6] ..... B65D 5/42

[52] U.S. Cl. ..... 229/125.39; 229/123.1

[58] Field of Search ..... 229/123.1, 125.37, 229/125.39, 183, 924; 383/71

[56] References Cited

U.S. PATENT DOCUMENTS

| | | | |
|---|---|---|---|
| Re. 26,742 | 12/1969 | Laskow | 292/132 |
| 1,076,897 | 10/1913 | Lettré | 229/125.39 |
| 1,364,225 | 1/1921 | Webb | 229/125.39 |
| 1,987,545 | 5/1932 | Alexander | 229/7 |
| 2,052,977 | 9/1936 | Hofmann | 229/123.1 |
| 2,063,999 | 12/1936 | Harrison | 229/125.39 |
| 2,188,039 | 6/1938 | Farmer | 229/62 |
| 2,400,406 | 5/1946 | Godoy | 229/123.1 |
| 2,828,905 | 6/1956 | Frizzell | 229/45 |
| 2,896,836 | 12/1956 | Bergstein | 229/37 |
| 2,998,180 | 3/1959 | Dehoney, Jr. | 229/43 |
| 3,064,876 | 2/1961 | Warner | 229/43 |
| 3,178,095 | 4/1965 | Hennefent | 229/125.39 |
| 3,276,664 | 10/1965 | Johnson | 229/48 |
| 3,345,920 | 10/1964 | Jordan | 93/36 |
| 3,608,707 | 9/1971 | Miller | 229/125.39 |
| 3,616,114 | 10/1971 | Osaka et al. | 161/39 |
| 4,557,971 | 12/1985 | Williams | 229/125.39 |
| 4,741,935 | 5/1988 | Sheehan, Jr. | 229/125.39 |
| 5,079,900 | 1/1992 | Pinckney et al. | 53/413 |
| 5,184,997 | 2/1993 | James et al. | 229/125.39 |
| 5,186,542 | 2/1993 | Seabold | 383/25 |
| 5,353,575 | 10/1994 | Stepanek | 53/461 |

FOREIGN PATENT DOCUMENTS

| | | | |
|---|---|---|---|
| 861580 | 2/1941 | France | B65D 5/02 |
| 2701453 | 8/1994 | France | B65B 51/06 |

OTHER PUBLICATIONS

Hanlon, Joseph F., Handbook of Packaging Engineering, 2nd Edition, 1984, McGraw-Hill (pp. 14-1 to 14-18).

Photograph of packaging kit marketed by Swiss Post Office.

*Primary Examiner*—Gary E. Elkins

*Attorney, Agent, or Firm*—Gary L. Griswold; Walter N. Kirn; James J. Trussell

[57] ABSTRACT

A self-contained container assembly which may be quickly and easily formed into a three-dimensional container without the need for additional components or tools which includes a container blank and a tape structure. The container blank includes (i) a plurality of laterally interconnected panels, and (ii) a set of closure flaps hingedly connected to the longitudinal ends of the panels at one end. The tape structure is attached to the container blank and includes (i) a release surface extending longitudinally along a first of the closure flaps from proximate the panel to which the closure flap is connected to proximate the distal end of the closure flap, and (ii) a length of closure adhesive tape extending over substantially the entire length of the first closure flap—in overlapping relationship to the release surface—and a distance across the panel to which the first closure flap is connected sufficient for the tape to remain attached to the container blank upon removal of that length of the tape extending across the first closure flap.

36 Claims, 5 Drawing Sheets

PRETAPED CONTAINER BLANKS

This is a continuation of application No. 08/132,805 filed Oct. 7, 1993, now abandoned.

FIELD OF THE INVENTION

The invention relates to corrugated fiberboard and paperboard containers and systems for erecting a three-dimensional container from a container blank or a collapsed container structure.

BACKGROUND

Cardboard containers are frequently erected from collapsed container structures by securing pressure sensitive box sealing tape along the seams between the closed side flaps. The tape is generally applied from a roll using automatic dispensing and taping equipment or a manually operable hand-held dispenser. Those who have attempted to perform the seemingly simple task of manually erecting a container structure and securing it with tape will attest to the fact that a certain level of skill and dexterity is required to retain the flaps in proper alignment while dispensing and applying the tape. An additional problem encountered by those who only occasionally erect such containers is that—in accordance with Murphy's Law—the roll of tape and dispensing tool are never to be found when they are needed.

Several efforts have been made to provide a fully self-contained container which is simple to assemble and does not require the use of additional tools.

U.S. Pat. No. 2,998,180 issued to Dehoney, Jr. discloses a self-sealing container wherein the exterior surface of one side closure flap at each end of the container is completely coated with an aggressive pressure sensitive adhesive covered with a release liner. The container is assembled at each end by folding the end flaps, folding the adhesive-coated side flap, removing the release liner, and folding the other side flap into adhesive engagement with the adhesive-coated side flap. While generally effective as a self-closing container, the container requires the use of substantial quantities of pressure sensitive adhesive, disposal of a sizable amount of release liner, and does not work with regular slotted containers (RSC) because of the need for fully overlapping side flaps.

U.S. Pat. Nos. 3,276,664, issued to Johnson, and 2,896,836, issued to Bergstein, disclose self-sealing containers wherein the overlapping surfaces of closure flaps are *image, (pattern) coated with an aggressive cohesive adhesive (bonds only to itself). The container is assembled at each end by first folding the end flaps and then folding the side flaps into adhesive engagement with the end flaps (Johnson) or each other (Bergstein). Those areas where the adhesive overlaps causes the flaps to bond together and thereby close the container. While generally effective as self-closing containers, the containers require that the adhesive be imaged onto the container within close tolerance levels to avoid premature bonding of the flaps and is subject to premature bonding of the individual flaps of a single container and the flaps of multiple containers due to shifting of the collapsed containers during shipping and handling. In addition, the fully assembled container is not sealed along the seam where the flaps come together and is subject to the introduction of contaminants into the container.

U.S. Pat. No. 3,345,920, issued to Jordan discloses a self-sealing container wherein paired adhesive coated strips are attached to the underside of each of the innermost flaps.

The strips extend upward through a slot in the innermost flaps positioned at the juncture of the outermost flaps for adhesively bonding to the exterior surface of each of the outermost flaps. While generally effective as self-closing container, the positioning of the adhesive strips produces a weakly bonded container.

While these configurations are generally acceptable for limited uses, a need continues to exist for a reliable, high quality, inexpensive, self-contained collapsed container which is simple and easy to assemble and seal.

SUMMARY OF THE INVENTION

We have discovered a self-contained container assembly which may be quickly and easily formed into a three-dimensional container and sealed without the need for additional components or tools. The container assembly includes a container blank and a tape structure. The container blank includes (i) a plurality of laterally interconnected panels, and (ii) a set of closure flaps hingedly connected to the longitudinal edges of the panels at one end. The tape structure is attached to the container blank and includes (i) a release surface extending longitudinally along a first of the closure flaps from proximate the panel to which the closure flap is connected to proximate the distal edge of the closure flap, and (ii) a length of closure adhesive tape extending over substantially the entire length of the first closure flap—in overlapping relationship to the release surface—and a distance across the panel to which the first closure flap is connected sufficient for the tape to remain attached to the container blank upon removal of that length of the tape extending across the first closure flap.

The tape structure is positioned along the width of the first closure flap so that the closure adhesive tape can secure the first set of closure flaps in an overlapping closed position by peeling the tape from the primary closure flap, folding the closure flaps in an overlapping relationship with the closure flaps positioned immediately to either side of the first closure flap closed last, and the closure tape adhesively applied over its original position on the first closure flap.

When the container blank forms a rectangular container with a pair of assembly opposed end flaps and a pair of assembly opposed side flaps, the container assembly can include multiple tape structures on each end flap. The tape structures are laterally positioned on the end flaps to cover imaginary longitudinal lines extending inward from the side edges of each end flap a distance equal to the length of the side flap located proximate that side of the end flap. Such a lateral positioning locates the closure tape along the seam formed between the pair of side flaps when the container is formed and the flaps are folded inward to close the end of the container.

DETAILED DISCUSSION OF THE INVENTION INCLUDING A BEST MODE

Definitions

Figure 1:
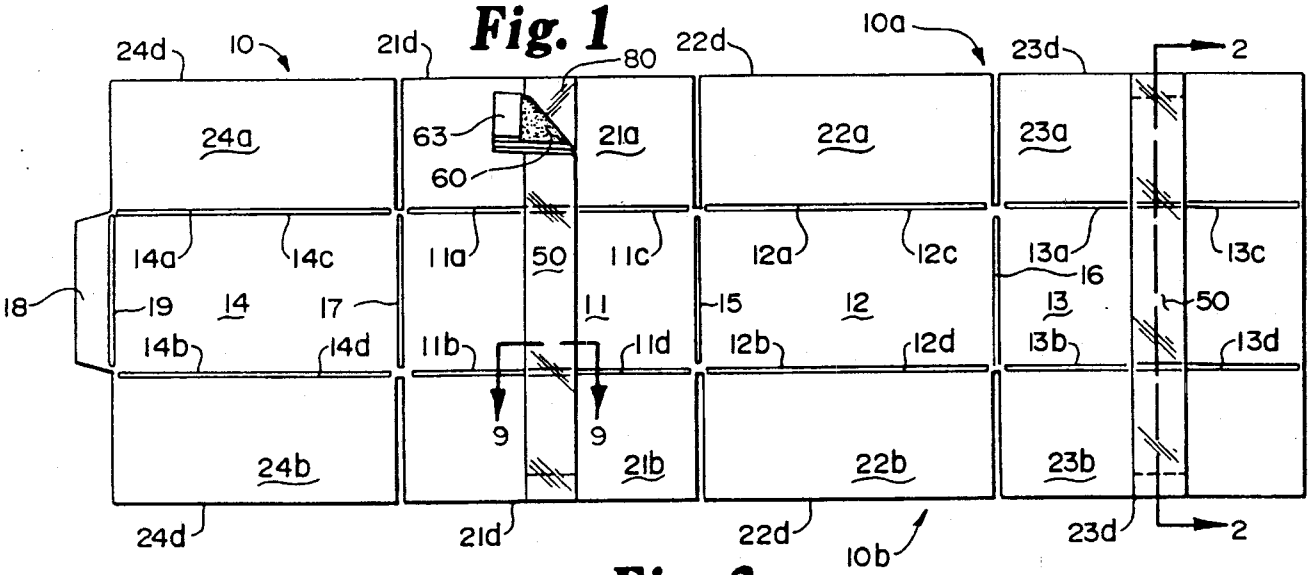
FIG. 1 is a plan view of one embodiment of a pretaped container blank of this invention including a first embodiment of a tape structure.

As used herein, including the claims, the phrase "assembly opposed flaps" means that the flaps are diametrically opposed to each other after the container is assembled. It is noted that flaps which are not diametrically opposed when the container is in blank form may become diametrically opposed when the container is assembled.

As used herein, including the claims, the phrase "regular slotted container" means a single piece fiber shipping container in which opposing flaps are the same length and the outer flaps meet in the center.

| Nomenclature | |
|---|---|
| 10 | Container Blank |
| 10a | First Open End of Container Blank |
| 10b | Second Open End of Container Blank |
| 11 | First Panel of Container |
| 11a | First Edge of First Panel |
| 11b | Second Edge of First Panel |
| 11c | Score Line Defining First Edge of First Panel |
| 11d | Score Line Defining Second Edge of First Panel |
| 12 | Second Panel of Container |
| 12a | First Edge of Second Panel |
| 12b | Second Edge of Second Panel |
| 12c | Score Line Along First Edge of Second Panel |
| 12d | Score Line Along Second Edge of Second Panel |
| 13 | Third Panel of Container |
| 13a | First Edge of Third Panel |
| 13b | Second Edge of Third Panel |
| 13c | Score Line Along First Edge of Third Panel |
| 13d | Score Line Along Second Edge of Third Panel |
| 14 | Fourth Panel of Container |
| 14a | First Edge of Fourth Panel |
| 14b | Second Edge of Fourth Panel |
| 14c | Score Line Along First Edge of Fourth Panel |
| 14d | Score Line Along Second Edge of Fourth Panel |
| 15 | Score Line Between First and Second Panels |
| 16 | Score Line Between Second and Third Panels |
| 17 | Score Line Between Fourth and First Panels |
| 18 | Attaching Flap |

-continued

| Nomenclature | |
|---|---|
| 19 | Score Line Between Fourth Panel and Attaching Flap |
| 21a | End Flap Extending from First Edge of First Panel |
| 21b | End Flap Extending from Second Edge of First Panel |
| 21d | Distal Edge of End Flaps On First Panel |
| 22a | Side Flap On First Edge of Second Panel |
| 22b | Side Flap On Second Edge of Second Panel |
| 22d | Distal Edge of Side Flaps On Second Panel |
| 23a | End Flap On First Edge of Third Panel |
| 23b | End Flap On Second Edge of Third Panel |
| 23d | Distal Edge of End Flaps On Third Panel |
| 24a | Side Flap On First Edge of Fourth Panel |
| 24b | Side Flap On Second Edge of Fourth Panel |
| 24d | Distal Edge of Side Flaps On Fourth Panel |
| 50 | Adhesive Tape Structure |
| 60 | Closure Adhesive Tape |
| 60m | Adhesive Layer of Closure Adhesive Tape |
| 60n | Backing Layer of Closure Adhesive Tape |
| 60w | Length of Closure Tape Bonded to Container |
| 60x | Length of Closure Tape Bonded to Target Tape |
| 60y | Length of Closure Tape Bonded to Release Surface |
| 60z | Length of Closure Tape (60w + 60x + 60y) |
| 61 | Fixed End of Closure Tape |
| 62 | Releasable End of Closure Tape |
| 63 | Tab at Releasable End of Closure Tape |
| 65 | Y-shaped Tape Structure |
| 66 | First Length of Tape |
| 67 | Second Length of Tape |
| 67a | First Section of Second Length of Tape |
| 67b | Bonded Mid-Section of Second Length of Tape |
| 67c | Second Section of Second Length of Tape |
| 70 | Target Tape |
| 70m | Adhesive Layer of Target Adhesive Tape |
| 70n | Backing Layer of Target Adhesive Tape |
| 80 | Release Surface |

Components

Container Blank

The container blank 10 must include at least one end flap 21/23 and a pair of assembly opposed side flaps 22*a*/24*a* or 22*b*/24*b* positioned at one end 10*a*/10*b* of the container blank 10. For purposes of facilitating a discussion of the invention, the invention will be described with a regular slotted container (RSC) 10 such as depicted in FIGS. 1–7.

Referring to FIG. 1, a regular slotted container blank 10 formed of conventional container materials, such as corrugated fiberboard, is shown prior to assembly. The container blank 10 is a unitary piece of material which includes a number of panels 11/12/13/14 and flaps 21*a*/22*a*/23*a*/24*a*/21*b*/22*b*/23*b*/24*b* defined by longitudinally extending 15/16/17 and laterally extending 11*c*/12*c*/13*c*/14*c*/11*d*/12*d*/13*d*/14*d* score lines formed in the container blank 10 in a conventional manner.

The container 10 may be formed from any of the widely accepted materials used to manufacture such containers 10 including corrugated fiberboard, flat fiberboard, corrugated polymeric and cellulosic fibers, sheets of solid polymeric materials, and the like.

The regular slotted container blank 10 includes first, second, third and fourth panels 11/12/13/14 separated from one another by substantially parallel longitudinally extending score lines 15/16//17. An attaching flap 18 extends from the side edge (unnumbered) of the fourth panel 14 and a score line 19 is formed between fourth panel 14 and attaching flap 18 for enabling the flap to be folded at substantially right angles to the fourth panel 14.

Panels 11/12/13/14 include first laterally extending edges 11*a*/12*a*/13*a*/14*a* defined by laterally extending score lines 11*c*/12*c*/13*c*/14*c* and second laterally extending edges 11*b*/12*b*/13*b*/14*b* defined by laterally extending score lines 11*d*/12*d*/13*d*/14*d* respectively. A first set of closure flaps 21*a*/22*a*/23*a*/24*a* are hingedly connected to panels 11/12/13/14 along the first laterally extending edges 11*a*/12*a*/13*a*/14*a* thereof for closing the first open end 10*a* of the container. Similarly, a second set of closure flaps 21*b*/22*b*/23*b*/24*b* are hingedly connected to panels 11/12/13/14 along the second laterally extending edges 11*b*/12*b*/13*b*/14*b* thereof for closing the second end 10*b* of the container. Each of the closure flaps 21*a*/22*a*/23*a*/24*a*/21*b*/22*b*/23*b*/24*b* are separated from one another along the longitudinally extending lateral edges (unnumbered) by slits or slots (unnumbered) so that the closure flaps 21*a*/22*a*/23*a*/24*a*/21*b*/22*b*/23*b*/24*b* may be independently bent along the respective laterally extending score lines 11*c*/12*c*/13*c*/14*c*/11*d*/12*d*/13*d*/14*d* for closing the erected container.

Adhesive Tape Structure

CLOSURE ADHESIVE TAPE

The adhesive tape structure 50 includes a length of closure adhesive tape 60 which may be peeled from the side flap 21*a*/21*b*/23*a*/23*b* of the container blank 10—without losing complete contact with the container blank 10—and adhesively bonded along the distal edges 22*d*/24*d* of a pair of opposed side flaps 22*a*/24*a* or 22*b*/24*b*. The reapplied closure tape 60 covers the seam (not shown) between the flaps 22*a*/24*a* or 22*b*/24*b* and bonds the pair of side flaps 22*a*/24*a* or 22*b*/24*b* together so as to close an open end of the container.

Two lengths of tape structure 50 are positioned at each open end 10*a*/10*b* of the container blank 10. The tape structure 50 must extend over a portion of the first 11 and third 13 panels and across the respective end flaps 21*a*/21*b*/23*a*/23*b* to at least proximate the distal edges 21*d*/23*d* of the end flaps 21*a*/21*b*/23*a*/23*b*. The tape structure 50 must be positioned relative to the second 12 and fourth 14 panels so that they are positioned directly underneath the seam (not shown) formed by each set of paired side flaps 22*a*/24*a* or 22*b*/24*b* when that open end 10*a*/10*b* of the container is closed. The lengths of tape structure 50 must be laminated to a release surface 80 at least along the surface of the end flaps 21*a*/21*b*/23*a*/23*b* so that the tape structure 50 may be peeled from the end flap 21*a*/21*b*/23*a*/23*b* and applied across the seam (not shown) of the corresponding pair of side flaps 22*a*/24*a* or 22*b*/24*b* during assembly.

Figure 2:
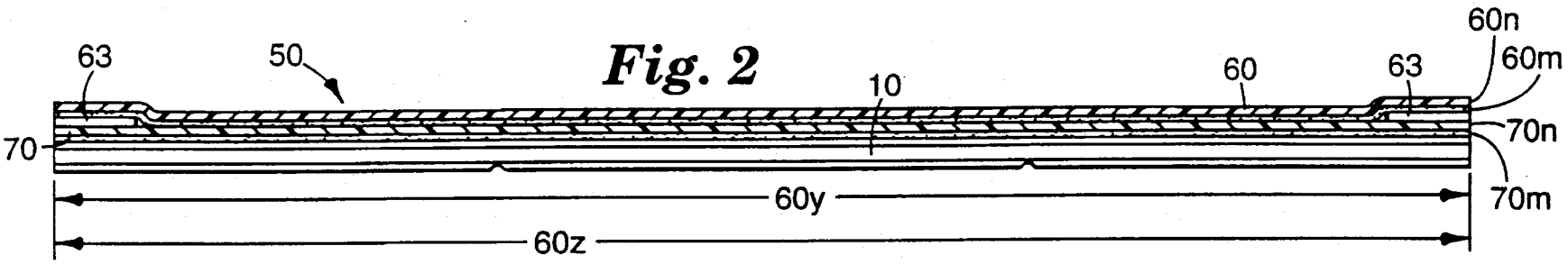
FIG. 2 is a cross-sectional view of the pretaped container of FIG. 1 taken along line 2—2 showing the layers of container, target tape adhesive, target tape backing, closure tape adhesive and closure tape backing.

Various configurations of tape structures 50 may be employed to achieve the necessary functionality described above. A first configuration is shown in FIGS. 1 and 2 where the release surface 80 and closure adhesive tape 60 extend completely across the entire length of the container blank 10 from the distal edge 21*d*/23*d* at one open end 10*a* to the distal edge 21*d*/23*d* at the other 10*b*. Release surface 80 in this embodiment is the release treated back surface of a second length of adhesive tape.

As shown in FIG. 1, this configuration does not include a length 60*w* of the closure adhesive tape 60 bonded to the container blank 10. The entire length 60*z* of closure tape 60 is laminated to the release surface 80.

This configuration is simple to manufacture but includes unnecessary lengths of closure tape 60 and release surface 80 along the center of the panels 11/13. In addition, the closure tape 60 is not permanently bonded to the container blank 10 anywhere along the length of the closure tape 60 such that a user—unfamiliar with the procedure for assembling the container blank 10—may mistakenly or accidentally remove the entire length of closure tape 60 from the container blank 10.

Figure 3:
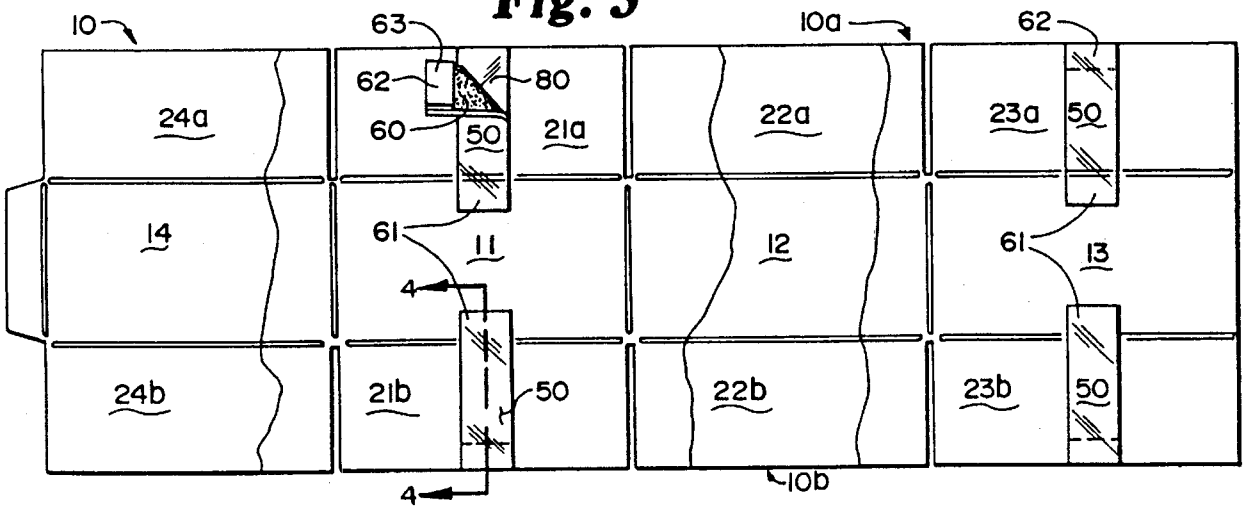
FIG. 3 is a plan view of one embodiment of a pretaped container blank of this invention including a second embodiment of a tape structure.
Figure 4:
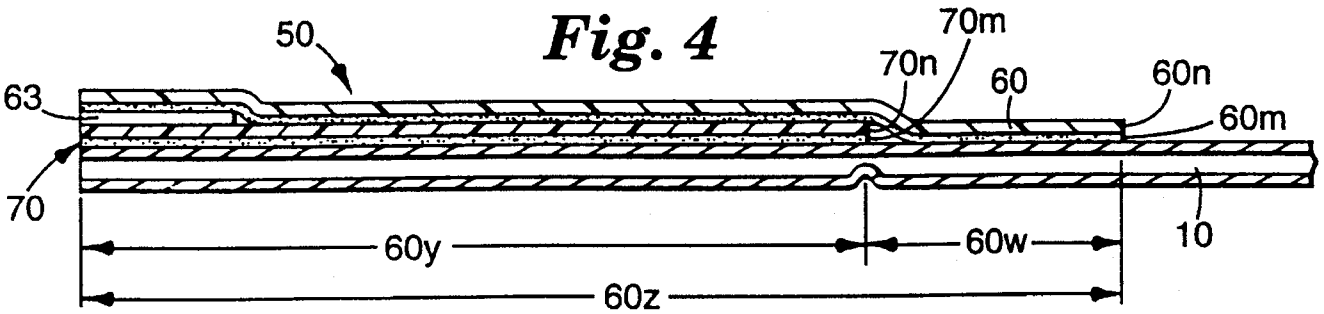
FIG. 4 is a cross-sectional view of the pretaped container of FIG. 3 taken along line 4—4 showing the layers of container, low adhesion backsize, closure tape adhesive and closure tape backing.

A second configuration is shown in FIGS. 3 and 4 where the release surface 80 extends only across the end flap 21*a*/21*b*/23*a*/23*b* and the closure adhesive tape 60 extends across both a portion of the panel 11/13 and the corresponding end flap 21*a*/21*b*/23*a*/23*b*. This configuration provides that each tape structure 50 includes a detachable length 60*y* of closure adhesive tape 60 laminated to a release surface 80 across the end flaps 21*a*/21*b*/23*a*/23*b* for closing the open end 10*a*/10*b* of the container blank 10 and a length 60*w* of closure adhesive tape 60 permanently bonded to the panel 11/13 of the container 10 for preventing complete removal of the closure tape 60 from the container blank 10 during assembly and securing the closure tape 60 and side flaps 22*a*/22*b*/24*a*/24*b* in position after assembly.

Figure 2A:
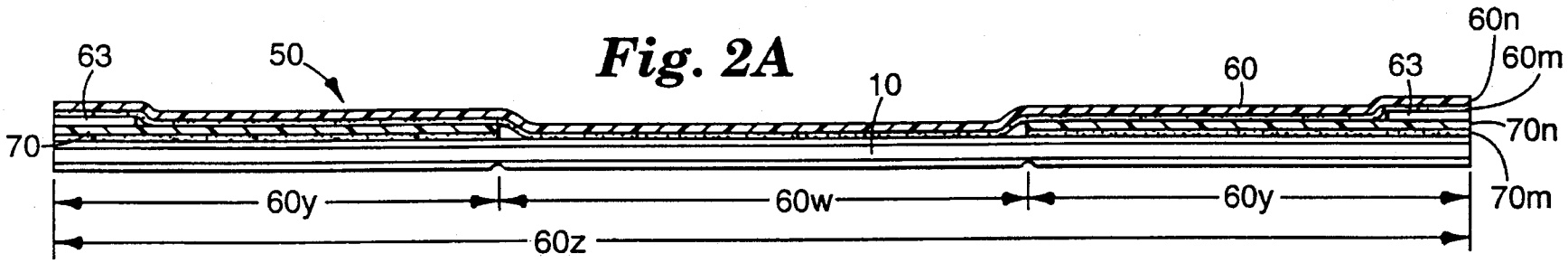
FIG. 2A is a view like FIG. 2 showing an alternative embodiment of the tape structure.

Alternatively, as shown in FIG. 2A, the second configuration may include a single length of closure tape 60 which extends across both end flaps 21*a*/21*b* or 23*a*/23*b* and the panel 11/13 to which the end flaps 21*a*/21*b* or 23*a*/23*b* are connected. Such an alternate embodiment simplifies construction of the container blank 10 by forming two tape structures 50 with a single length of closure tape 60.

While generally acceptable, the second configuration is not completely foolproof. Conceivably, a user—unfamiliar with the procedure for assembling the container blank 10—may mistakenly peel the closure tape 60 not only from the end flaps 21*a*/21*b*/23*a*/23*b* as appropriate but also from the panel 11/13 of the container blank 10 even though removal from the panel 11/13 is much more difficult and will tend to rip the container blank 10.

Figure 9A:
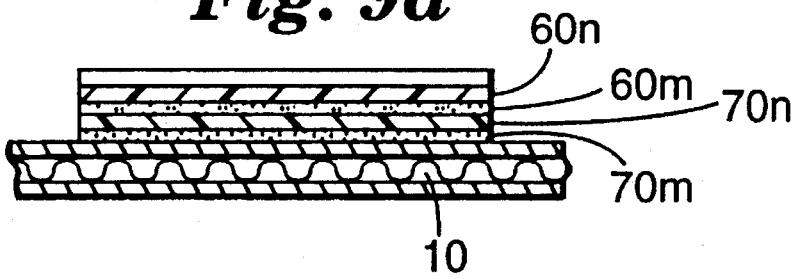
FIG. 9*a* is a cross-sectional view of the pretaped container of FIG. 1 taken along line 9—9 showing the layers of the container, target tape adhesive, target tape backing, closure tape adhesive and closure tape backing.
Figure 9B:
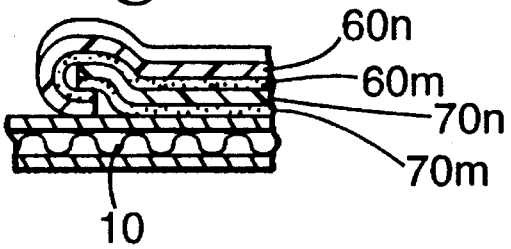
FIG. 9*b* is a view like FIG. 9*a*, showing an alternate arrangement of the closure tape and target tape.
Figure 9C:
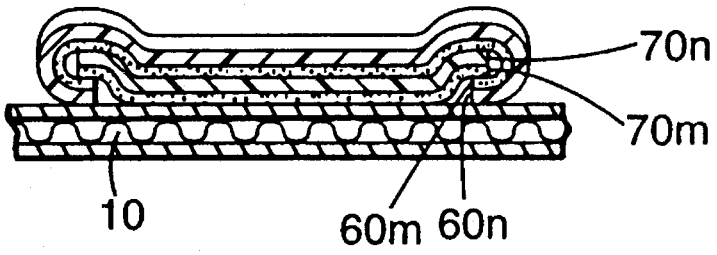
FIG. 9*c* is a view like FIG. 9*b*, showing another alternate arrangement of the closure tape and target tape.

One option for preventing complete removal of the closure tape 60 from the container 10 is to use a target tape 70 as the release surface 80, forming a longitudinally extending laterally overhanging length of closure tape 60 by either employing a closure tape 60 which is wider than the target tape 70 or laterally offsetting the closure tape 60 relative to the target tape 70, and then—along at least a portion of the tape structure 50 connected to the panel 11/12/13—folding or tucking the overhanging longitudinal edge of the closure tape 60 under the target tape 70 to form an adhesive-to-adhesive bond between the tapes 60/70 as shown in FIGS. 9*b* and 9*c*. Formation of such a longitudinally hemmed adhesive tape structure is disclosed in U.S. Pat. No. 5,079,900 issued to Pinckney et al. and assigned to the Minnesota Mining and Manufacturing Company.

Figure 5:
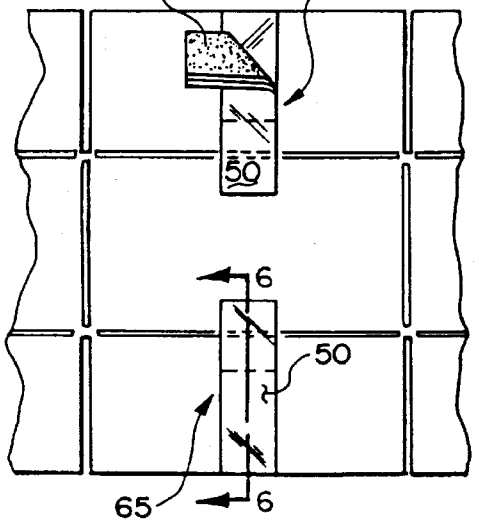
FIG. 5 is a plan view of one embodiment of a pretaped container blank of this invention including a third embodiment of a tape structure.
Figure 6:
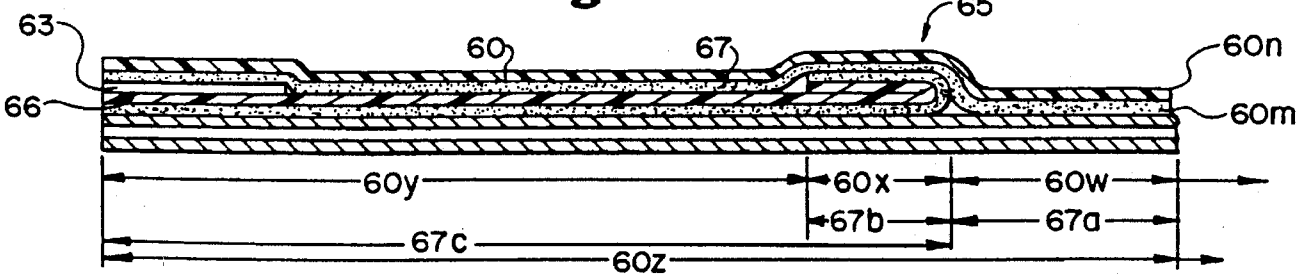
FIG. 6 is a cross-sectional view of the pretaped container of FIG. 5 taken along line 6—6 showing the various layers of container, adhesive and backing.
Figure 8:
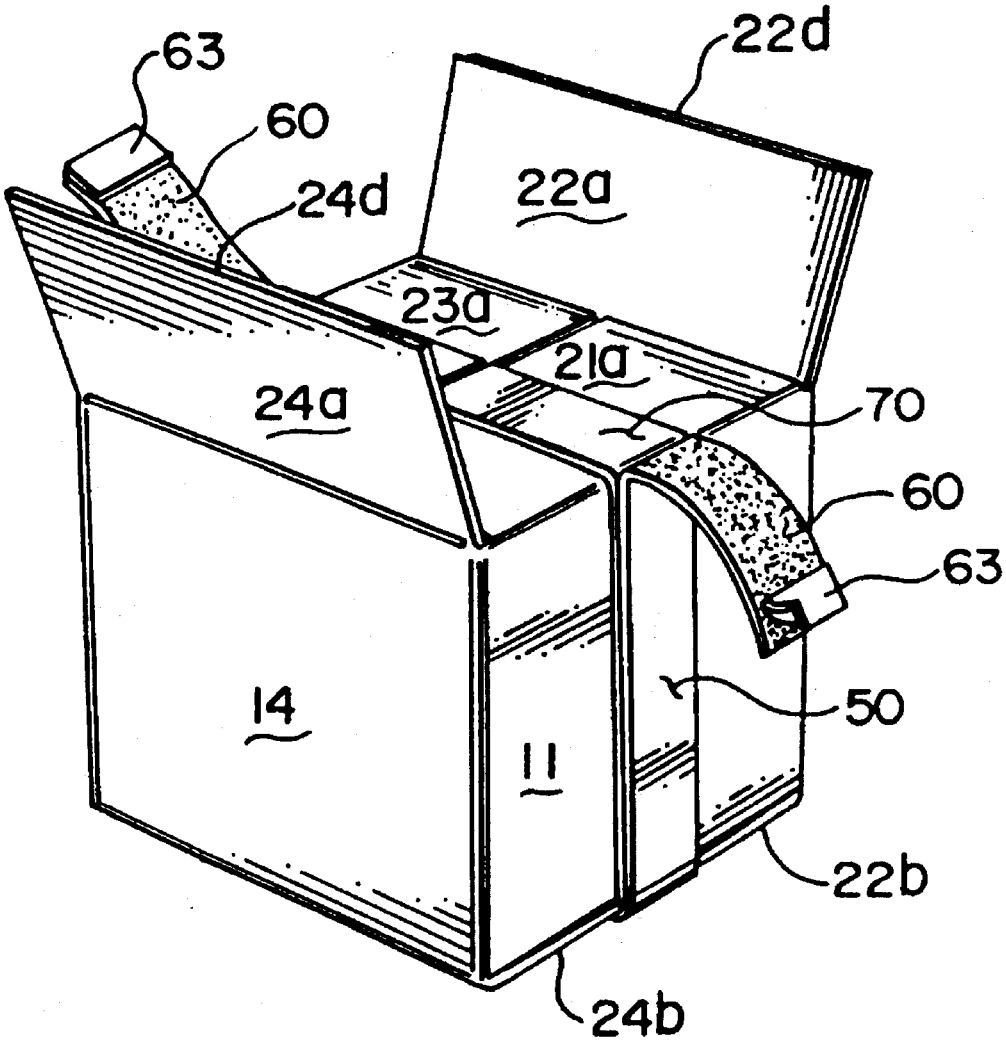
FIG. 8 is a partially assembled perspective view of the pretaped container of FIG. 1.

A nearly foolproof configuration is shown in FIGS. 5 and 6. A Y-shaped tape structure 65 is formed by contacting the end of a first length of tape 66 to the mid-section of a second length of tape 67 with the adhesive coated surfaces of both lengths bonded together for a short distance 60*x*. The first length of tape 66 (one of the legs of the Y structure) divides the second length of tape 67 into a first adhesive section 67*a* (the other leg of the Y structure), a bonded mid-section 67*b* where the first 66 and second 67 lengths of closure tape 60 are joined, and a second adhesive section 67*c* which—along with the bonded mid-section 67*b*—forms the base of the Y structure.

The Y-shaped tape structure 65 is applied to the container blank 10 by (i) positioning the crotch of the Y-shaped tape structure 65 proximate to the score line 11*c*/11*d*/13*c*/13*d* between the panel 11/13 and corresponding end flap 21*a*/

21*b*/23*a*/23*b* to which the tape structure 65 is to be attached with the crotch parallel to the score line 11*c*/11*d*/13*c*/13*d* and resting either directly on the score line 11*c*/11*d*/13*c*/13*d* or the panel 11/13 but not the end flap 21*a*/21*b*/23*a*/23*b*, (ii) adhesively bonding the first length of tape 66 (one of the legs of the Y) to the end flap 21*a*/21*b*/23*a*/23*b*, (iii) adhesively bonding the first adhesive section 67*a* of the second length of tape 67 (the other leg of the Y) to the corresponding panel 11/13, and (iv) aligning the bonded mid-section 67*b* and second adhesive 67*c* sections of the second length of tape 67 (the base of the Y) with the previously applied first length of tape 66. The first length of tape 66 functions as a release surface 80 for the second adhesive section 67*c* of the second length of tape 67. The legs of the Y-shaped tape structure 65—which are adhesively bonded to the container blank 10 in opposite directions—prevent the tape structure 65 from being peeled from the container blank 10 by pulling on the second adhesive section 67*c* of the second length of tape 67.

When the side flaps 22*a*/22*b*/24*a*/24*b* of the container blank 10 are wider than the length of the end flaps 21*a*/21*b*/23*a*/23*b* the tape structure 50 may be extended over the distal edge 21*d*/23*d* of the end flap 21*a*/21*b*/23*a*/23*b* and onto the back surface (unnumbered) of the end flap 21*a*/21*b*/23*a*/23*b* in order to provide a length of closure adhesive tape 60 long enough to extend across substantially the entire seam (not shown) between the side flaps 22*a*/24*a* or 22*b*/24*b*. The back surface (unnumbered) of the end flaps 21*a*/21*b*/23*a*/23*b* is treated with a release coating to allow the closure tape 60 to be peeled from the end flap 21*a*/21*b*/23*a*/23*b* for use in assembling the container 10.

Backing

Tapes useful in the manufacture of this invention include those tapes having backings made of mono-axially and biaxially oriented polypropylene, oriented polyester, filament/fiber combinations, paper and the like.

Adhesive

The adhesive may be selected from any of the well known and widely available aggressive adhesives used with box closure tapes. The adhesive may be a heat-activated adhesive such as ethylene vinyl acetate adhesives (particularly those having a high vinyl acetate content of about 18–30 wt %); a water-activated adhesive such as a gummed adhesive; a pressure sensitive adhesive such as acrylate adhesives and tackified block copolymer adhesives; etc. Because of the ease with which such closure tapes 60 may be applied, the preferred adhesive is an aggressive pressure sensitive adhesive.

Particularly suitable pressure sensitive adhesive tapes for use as the closure tape 60 in the present invention include SCOTCH® brand tapes 373 and 375 available from the Minnesota Mining and Manufacturing Company of St. Paul, Minn.

Figure 7:
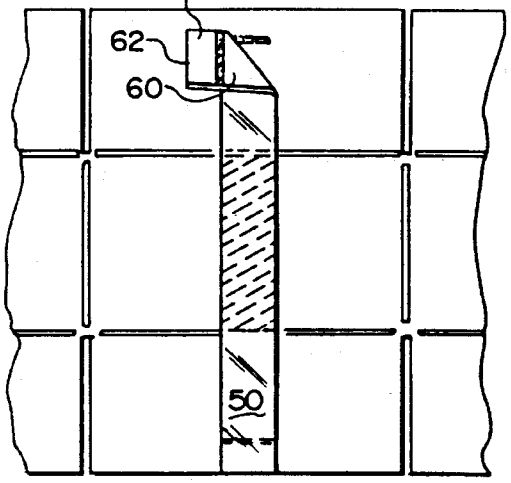
FIG. 7 is a plan view of a fourth embodiment of a tape structure which includes areas of pre-activated adhesive.

Closure tapes 60 using adhesives which do not possess any tack until activated, such as the gummed adhesives, must be activated in strategic locations during assembly of the pretaped container blank 10 so that the closure tape 60 will adhere to the container blank 10 during shipping, handling and storage. The surface area of the closure tape 60 which is pre-activated must be strictly limited since the pre-activated areas will not be available for bonding to the side flaps 22*a*/22*b*/24*a*/24*b* during assembly and oversized areas will tend to lift strips of paper from the container blank 10. One example of a suitable configuration is depicted in FIG. 7 where the width of the pre-activated lines is about 1 to 2 mm. Other suitable configurations include a dotted pattern of activated adhesive or the inclusion of a thin line of pressure sensitive adhesive.

Tab

The releasable end 62 of the closure adhesive tape 60 includes a releasable tab 63, also known as a lift tab or a finger tab, when a pressure sensitive adhesive is employed. The tab 63 prevents the releasable end 62 from adhesively bonding to the release surface 80 so that the releasable end 62 may be readily gripped for peeling of the closure adhesive tape 60 from the release surface 80. The tab 63 is preferably releasably bonded to the closure tape 60 so that the tab 63 may be removed after application of the closure adhesive tape 60 to the side flaps 22*a*/22*b*/24*a*/24*b* and that portion of the closure adhesive tape 60 covered by the tab 63 also applied to the side flaps 22*a*/22*b*/24*a*/24*b*. Suitable materials for use as the release tab 63 include silicone coated paper sheets or plastic films.

The releasable tab 63 may be eliminated by simply folding the releasable end 62 of the closure adhesive tape 60 back upon itself in adhesive-to-adhesive contact to create a nonadhesive tab 63 at the releasable end 62 of the closure tape 60. While this option is generally simpler, less expensive and results in the generation of less waste, it is only practical where the presence of a nonadhesive tab 63 extending from the completely assembled box is acceptable from both a functional and aesthetic standpoint. Numerous other options are also available including coating the adhesive at the releasable end 62 of the closure tape 60 with a detackifying agent such as wax or talc; covering the releasable end 62 of the closure tape 60 with printing ink; manufacturing closure tape 60 which does not coat the releasable end 62 of the closure tape 60 with adhesive 60*m*; etc.

RELEASE SURFACE

A release surface 80 is required when a pressure sensitive adhesive tape is employed. The release surface 80 provides appropriate release characteristics so that the pressure sensitive adhesive on the closure tape 60 may be peeled from the release surface 80 without leaving an adhesive residue on the release surface 80 and without lifting fragments of the release surface 80 which would interfere with adhesive bonding of the closure tape 60 to the side flaps 22*a*/22*b*/24*a*/24*b*.

Any material capable of forming a bond with the container blank 10 which is sufficient to prevent delamination of the material from the container blank 10 when the closure adhesive tape 60 is peeled from the material and possessing the release characteristics outlined above may be used to form the release surface 80. Suitable materials include target tapes and release coatings.

Target Tapes

Adhesive tapes used to form a release surface 80 are known as target tapes 70. Tapes suitable for use as a target tape 70 include tapes that adhere well to the container 10 and have a backing surface from which an adhesive closure tape 60 will release without lifting of the target tape 70 from the container 10 or leaving residual adhesive 60*m* on the target tape 70. Examples of suitable pressure sensitive adhesive tapes suitable for use as the target tape 70 in the present invention include the same SCOTCH® brand tapes disclosed above as suitable for use as the closure tape 60 in this invention.

Release Coating

A release coating can be applied to the container blank 10 to provide the desired release surface 80. The release coating provides a surface on the container blank 10 with a reduced adhesive affinity for the pressure sensitive adhesive 60*m* on the closure tape 60.

Materials suitable as for use as the release coating include acrylates, fluorochemicals, polyethylenes, silicones, epoxy silicones, vinyl copolymers and combinations of these compounds. Additional compounds suitable for use as the release coating are disclosed in U.S. Pat. No. 4,728,571 issued to Clemens et al. One family of commercially available silicone release coatings are available from Dow Corning Corporation of Midland, Mich. under the mark SYL-OFF®. Preferred types of low adhesion backsize are the siloxane and acrylate based compounds disclosed in U.S. Pat. No. 4,973,513 issued to Riedel and the water-insoluble hydrophobic urethane (carbamate) copolymer of polyvinyl alcohol and octadecyl isocyanate disclosed in U.S. Pat. No. 2,532,011 issued to Dahlquist et al, both assigned to the Minnesota Mining and Manufacturing Company of St. Paul, Minn.

The release coating may be applied by any of the conventional water or solvent-based coating techniques including air knife, trailing blade, direct and offset gravure, Meyer bar, wire-wound rod, reverse roll, roll coating, print bond and spray coating.

When a low-adhesion backsize is employed to form the release coating, a dried coating weight of at least about 0.04 mg backsize per $cm^2$ container surface is generally effective for achieving the desired reduction in adhesion.

A final option available for providing the desired release characteristics with closure adhesive tapes 60 employing a pressure sensitive adhesive 60*m* is the use of a release liner (not shown) covering the adhesive 60*m*. The liner (not shown) would include a discontinuity such as a hole or slit (not shown) in the liner near the releasable end 62 of the closure tape 60 through which the adhesive 60*m* could adhere to the container blank 10 and hold the closure tape 60 in position until the container blank 10 is assembled. Because of the additional refuse generated by the need to remove and dispose of the liner (not shown) during assembly, this embodiment is not the embodiment of choice for most applications.

The pretaped container blank 10 may be rendered reusable by also positioning a release surface 80 over the surface of the side flaps 22*a*/24*a*/22*b*/24*b* which will be contacted by the closure tape 60 in the assembled container. However, it must be remembered that incorporation of a release surface 80 on the side flaps 22*a*/24*a*/22*b*/24*b* will decrease the strength of the adhesive bond between the closure tape 60 and the side flaps 22*a*/24*a*/22*b*/24*b* and may not be suitable for those applications where maximum strength is required.

Formation of Container

The free ends of the container blank are brought together and joined by means of the attaching flap 18 using a manufacturer's joint. The manufacturer's joint is formed by the manufacturer and may be achieved with taped joints, glued joints or wire-stitched joints. The jointed container blank 10 may then be assembled into a three-dimensional container by (i) folding the end flaps 21*a*/23*a* towards each other until they form a flat surface relative to one another, (ii) peeling the releasable adhesive tape 60*y* from at least the entire length of each end flap 21*a*/23*a*, (iii) folding the side flaps 22*a*/24*a* over the folded end flaps 21*a*/23*a* to form a flat surface, and (iv) applying the lengths of adhesive tape 60*y* peeled from the end flaps 21*a*/23*a* over the seam (not shown) between the side flaps 22*a*/24*a* so as to connect the side flaps 22*a*/24*a* and close the first end of the container. Once the desired contents have been placed in the container the container may be sealed by simply repeating steps (i) through (iv) above for the second end of the container.

In addition to the aspects described herein, the container 10 may also include customary enhancements such as an address label, internal cushioning, etc.

We claim:

1. A pretaped container blank for assembly into a three-dimensional container, comprising:

(a) a container blank including (i) a plurality of laterally interconnected panels, including a primary panel, each of said panels including first and second longitudinal ends defining first and second laterally extending edges respectively, and (ii) a first set of closure flaps, including at least one first primary closure flap, each flap of the closure flaps having a proximal edge hingedly connected to an adjoining one of the first laterally extending edges of the panels and a distal edge longitudinally spaced from the panels wherein the closure flaps are in paired relationship with the panels; and (b) a tape structure attached to the container blank and including at least (i) a release surface extending longitudinally along the primary closure flap from proximate the proximal edge to proximate the distal edge of the primary closure flap, and (ii) a length of closure adhesive tape, wherein a first portion of the closure adhesive tape is mounted on the release surface and extends over substantially the entire length of the primary closure flap and a second portion of the closure adhesive tape is mounted a distance across the adjoining panel sufficient for the closure adhesive tape to remain attached to the container blank upon removal of the first portion from the primary closure flap;

wherein the tape structure is positioned along the proximal edge of the primary closure flap such that the closure adhesive tape can secure the first set of closure flaps in an overlapping closed position in the assembled container by peeling the tape from the primary closure flap, folding the closure flaps in an overlapping relationship with the closure flaps positioned immediately to either side of the primary closure flap closed last, and the closure tape adhesively applied to the last closed closure flaps over its original position on the primary closure flap.

2. The pretaped container blank of claim 1 wherein the container blank includes four laterally interconnected panels configured to be assembled into a rectangular container.

3. The pretaped container blank of claim 1 wherein the container blank is a regular slotted cardboard container blank.

4. The pretaped container blank of claim 1 wherein the release surface is target tape.

5. The pretaped container blank of claim 1 wherein the release surface is a layer of release coating.

6. The pretaped container blank of claim 1 further comprising a second set of closure flaps including at least one second primary closure flap wherein each flap of the second set includes a proximal edge hingedly connected to the adjoining one of the second laterally extending edges of the panels and distal edges longitudinally spaced from the panels wherein the closure flaps of the second set are in paired relationship with the panels.

7. The pretaped container blank of claim 6 wherein (i) the first primary closure flap is hingedly connected to the first laterally extending edge of the primary panel and the second primary closure flap is hingedly connected to the second laterally extending edge of the primary panel, and (ii) both the release surface and adhesive closure tape components of the tape structure extend continuously from proximate the distal edge of the first primary closure flap to proximate the distal edge of the second primary closure flap.

8. The pretaped container blank of claim 7 wherein (i) the release surface is a target tape, (ii) the adhesive closure tape is positioned relative to the target tape such that a first longitudinal edge of the adhesive tape laterally extends beyond a first longitudinal edge of the target tape so as to define a first longitudinally elongated margin along the adhesive tape, and (iii) a portion of the first margin is folded around the first longitudinal edge of the target tape so as to place the adhesive closure tape and target tape in adhesive-to-adhesive engagement at a first location.

9. The pretaped container blank of claim 6 wherein (i) the first primary closure flap is hingedly connected to the first laterally extending edge of the primary panel and the second primary closure flap is hingedly connected to the second laterally extending edge of the primary panel, (ii) the release surface extends longitudinally along both of the first and second primary closure flaps from proximate the proximal edge to proximate the distal edge of each of the first and second primary closure flaps, respectively, and (iii) the adhesive closure tape extends continuously from proximate the distal edge of the first primary closure flap to proximate the distal edge of the second primary closure flap whereby the adhesive closure tape overlaps the release surfaces on the first and second primary flaps and directly contacts the primary panel.

10. The pretaped container blank of claim 9 wherein (i) the release surface is a target tape, (ii) the adhesive closure tape is positioned relative to the target tape such that a first longitudinal edge of the adhesive closure tape laterally extends beyond a first longitudinal edge of the target tape so as to define a longitudinally elongated margin along the adhesive tape, and (iii) a portion of the margin is folded around the first longitudinal edge of the target tape so as to place the adhesive closure tape and target tape in adhesive-to-adhesive engagement.

11. The pretaped container blank of claim 6 wherein the container includes at least two separate tape structures with one configured and arranged relative to each of the first and second primary closure flaps.

12. The pretaped container blank of claim 1 wherein the tape structure comprises a first length of tape having an adhesive side and a second length of tape having an adhesive side, wherein (i) the adhesive side of the first length of tape is adhesively bonded at a first end to the adhesive side of the second length of tape for a distance effective to aggressively bond the lengths of tape and form a bonded mid-section of the second length of tape between a first adhesive section and a second adhesive section of the second length of tape, (ii) the first length of tape is longitudinally adhesively bonded at a second end to the primary closure flap to form the release surface, (iii) the first adhesive section of the second length of tape is longitudinally adhesively bonded to the panel hingedly connected to the primary closure flap, and (iv) the second adhesive section of the second length of tape is releasably adhesively attached to the previously applied first length of tape in an overlapping fashion.

13. The pretaped container blank of claim 1 wherein the primary closure flap has an outward facing surface and an inward facing surface and the tape structure extends across the outward facing surface, wraps around the distal edge of the primary closure flap, and extends along the inward facing surface of the primary closure flap.

14. The pretaped container blank of claim 1 wherein the adhesive tape extends about 2 to 10 cm into the adjoining panel.

15. The pretaped container blank of claim 8, wherein the adhesive closure tape is wider than the target tape.

16. The pretaped container blank of claim 15 wherein (i) the adhesive closure tape is positioned relative to the target tape such that a second longitudinal edge of the adhesive tape laterally extends beyond a second longitudinal edge of the target tape so as to define a second longitudinally elongated margin along the adhesive tape, and (ii) a portion of the second margin is folded around the second longitudinal edge of the target tape so as to place the adhesive closure tape and target tape in adhesive-to-adhesive engagement at a second location.

17. The pretaped container blank of claim 10, wherein the adhesive closure tape is wider than the target tape.

18. The pretaped container blank of claim 17 wherein (i) the adhesive closure tape is positioned relative to the target tape such that a second longitudinal edge of the adhesive tape laterally extends beyond a second longitudinal edge of the target tape so as to define a second longitudinally elongated margin along the adhesive tape, and (ii) a portion of the second margin is folded around the second longitudinal edge of the target tape so as to place the adhesive closure tape and target tape in adhesive-to-adhesive engagement at a second location.

19. A pretaped container blank which may be assembled into a three-dimensional container, comprising:

(a) a container blank including:

(1) a plurality of laterally interconnected panels each including upper and lower edges, and (2) a first set of closure flaps each connected to an adjoining one of the upper edges of the panels, respectively; each closure flap positioned in paired relationship with one of the plurality of panels, respectively, and having a hinged edge, a distal edge, a hinged edge to distal edge length, a left side edge, a right side edge, and a side edge to side edge width; said first set including at least a pair of assembly opposed first end flaps and a pair of assembly opposed first side flaps and (b) a plurality of tape assemblies attached to the container blank, each tape assembly including at least:

(1) a release surface extending along each of the end flaps, respectively from proximate the hinged edge to proximate the distal edge of each of the end flaps, and (2) a length of adhesive tape, wherein a first portion of the adhesive tape is mounted to the release surface and extends over substantially the entire length of each end flap and a second portion of the adhesive tape is mounted for a distance across the adjoining panel sufficient for the adhesive tape to remain attached to the container blank upon removal of the first portion of the adhesive tape from the end flap; wherein the distance from the left side edge of each end flap to the adhesive tape of each end flap is less than the width of the side flap adjacent the left edge of the end flap, and the distance from the right side edge of each end flap to the adhesive tape of each end flap is less than the width of the side flap adjacent the right side edge of the end flap.

20. The pretaped container blank of claim 19 wherein the container blank includes four laterally interconnected panels configured to be assembled into a rectangular container.

21. The pretaped container blank of claim 19 wherein the container is a regular slotted cardboard container blank.

22. The pretaped container blank of claim 19 wherein the release surface is target tape.

23. The pretaped container blank of claim 19 wherein the release surface is a layer of release coating.

24. The pretaped container blank of claim 19 further comprising a second set of closure flaps, each connected to an adjoining one of the lower edges of the panels, respectively; each closure flap in the second set positioned in paired relationship with one panel of the plurality of panels, respectively, and having a hinged edge, a distal edge, a hinged edge to distal edge length, a left side edge, a right side edge, and a side edge to side edge width, said second set including at least a pair of assembly opposed second end flaps and a pair of assembly opposed second side flaps.

25. The pretaped container blank of claim 24 wherein (i) the panels include a first panel and a second panel, (ii) one of the first end flaps is hingedly connected to the first panel and the other of the first end flaps is hingedly connected to the second panel, (iii) one of the second end flaps is hingedly connected to the first panel and the other second end flap is hingedly connected to the second panel, and (iv) one of the release surface and adhesive tape components of the tape assemblies extends continuously from proximate the distal edge of the first end flap connected to the first panel to proximate the distal edge of the second end flap connected to the first panel and another of the release surface and adhesive tape components of the tape assemblies extends continuously from proximate the distal edge of the first end flap connected to the second panel to proximate the distal edge of the second end flap connected to the second panel.

26. The pretaped container blank of claim 25 wherein (i) the release surface is a target tape, (ii) the adhesive tape is positioned relative to the target tape such that a first longitudinal edge of the adhesive tape laterally extends beyond a first longitudinal edge of the target tape so as to define a first longitudinally elongated margin along the adhesive tape, and (iii) a portion of the first margin is folded around the first longitudinal edge of the target tape so as to place the adhesive tape and target tape in adhesive-to-adhesive engagement at a first location.

27. The pretaped container blank of claim 24 wherein (i) the panels include a first panel and a second panel, (ii) one of the first end flaps is hingedly connected to the first panel and the other of the first end flaps is hingedly connected to the second panel, (iii) one of the second end flaps is hingedly connected to the first panel and the other second end flap is hingedly connected to the second panel, (iv) the release surface component of the tape structure extends longitudinally along each of the first and second end flaps from proximate the hinged edge to proximate the distal edge of each of the first and second end flaps, and (v) one adhesive tape component of the tape structure extends continuously from proximate the distal edge of the first end flap connected to the first panel to proximate the distal edge of the second end flap connected to the first panel whereby the adhesive tape overlaps the release surfaces on the first and second end flaps and directly contacts the first panel, and another adhesive tape component of the tape structure extends continuously from proximate the distal edge of the first end flap connected to the second panel to proximate the distal edge of the second end flap connected to the second panel whereby the adhesive tape overlaps the release surfaces of the first and second end flaps and directly contacts the second panel.

28. The pretaped container blank of claim 27 wherein (i) the release surface is a target tape, (ii) the adhesive tape is positioned relative to the target tape such that a first longitudinal edge of the adhesive tape laterally extends beyond a first longitudinal edge of the target tape so as to define a longitudinally elongated margin along the adhesive tape, and (iii) a portion of the margin is folded around the first longitudinal edge of the target tape so as to place the adhesive tape and target tape in adhesive-to-adhesive engagement.

29. The pretaped container blank of claim 19 wherein each tape structure comprises a first length of tape having an adhesive side and a second length of tape having an adhesive side, wherein (i) the adhesive side of the first length of tape is adhesively bonded at a first end to the adhesive side of the second length of tape for a distance effective to aggressively bond the lengths of tape and form a bonded mid-section of the second length of tape between a first adhesive section and a second adhesive section of the second length of tape, (ii) the first length of tape of each tape structure is longitudinally adhesively bonded to one of the end flaps to form the release surface, (iii) the first adhesive section of the second length of tape of each tape structure is longitudinally adhesively bonded to the panel hingedly connected to the end flap to which the tape structure is attached, and (iv) the second adhesive section of the second length of tape of each tape structure is releasably adhesively attached to the previously applied first length of tape in an overlapping fashion.

30. The pretaped container blank of claim 19 wherein each of the end flaps have an outward facing surface and an inward facing surface and the tape structure extends across the outward facing surface, wraps around the distal edge of the primary closure flap, and extends along the inward facing surface of the end flaps.

31. The pretaped container blank of claim 19 wherein the adhesive tape extends about 3 to 7 cm into the adjoining panel.

32. The pretaped container blank of claim 26, wherein the adhesive closure tape is wider than the target tape.

33. The pretaped container blank of claim 32 wherein (i) the adhesive closure tape is positioned relative to the target tape such that a second longitudinal edge of the adhesive tape laterally extends beyond a second longitudinal edge of the target tape so as to define a second longitudinally elongated margin along the adhesive tape, and (ii) a portion of the second margin is folded around the second longitudinal edge of the target tape so as to place the adhesive closure tape and target tape in adhesive-to-adhesive engagement at a second location.

34. The pretaped container blank of claim 27, wherein the adhesive closure tape is wider than the target tape.

35. The pretaped container blank of claim 34 wherein (i) the adhesive closure tape is positioned relative to the target tape such that a second longitudinal edge of the adhesive tape laterally extends beyond a second longitudinal edge of the target tape so as to define a second longitudinally elongated margin along the adhesive tape, and (ii) a portion of the second margin is folded around the second longitudinal edge of the target tape so as to place the adhesive closure tape and target tape in adhesive-to-adhesive engagement at a second location.

36. A pretaped container blank for assembly into a three-dimensional container, comprising:

(a) a container blank having (i) a plurality of laterally interconnected panels each including first and second longitudinal ends defining first and second laterally extending edges, respectively, and (ii) a first set of closure flaps, including one primary closure flap, each flap of said closure flaps including a proximal edge hingedly connected to an adjoining one of the first laterally extending edges of the panels and a distal edge longitudinally spaced from the panels wherein the closure flaps are in paired relationship with the panels; and (b) an adhesive tape structure attached to the container blank and including (i) an adhesively unactivated length extending over substantially the entire length of the primary closure flap with a first longitudinal end of the tape on the primary closure flap, (ii) an adhesively activated length extending across the adjoining panel for at least a distance sufficient for the tape to remain attached to the container blank upon removal of the unactivated length of the tape extending across the primary closure flap, and (iii) a small adhesively activated area proximate the first longitudinal end of the tape operative for holding the unactivated length of tape in position against the container.

* * * * *

UNITED STATES PATENT AND TRADEMARK OFFICE

CERTIFICATE OF CORRECTION

PATENT NO.: 5,465,900

DATED: November 14, 1995

INVENTOR(S): Eugene L. Baratto et al.

It is certified that error appears in the above-identified patent and that said Letters Patent is hereby corrected as shown below:

Col. 1, line 49, "*image," should be --*image*--.

Col. 14, line 3, "of" should be --on--.

Signed and Sealed this

Thirteenth Day of August, 1996

*Attest:*

BRUCE LEHMAN

*Attesting Officer*

*Commissioner of Patents and Trademarks*